United States Patent [19]

Smith

[11] 3,999,608

[45] Dec. 28, 1976

[54] OIL WELL GRAVEL PACKING METHOD AND APPARATUS

[76] Inventor: Donald M. Smith, 13282 La Vaughn Drive, Garden Grove, Calif. 92664

[22] Filed: Sept. 22, 1975

[21] Appl. No.: 615,717

[52] U.S. Cl. ..... 166/278; 166/51; 166/334

[51] Int. Cl.[2] ..... E21B 43/10

[58] Field of Search ..... 166/51, 74, 169, 205, 166/228, 276, 278, 296, 315, 53, 226

[56] References Cited

UNITED STATES PATENTS

| | | | |
|---|---|---|---|
| 2,224,630 | 12/1940 | Dean et al. | 166/205 |
| 2,241,439 | 5/1941 | Ball | 166/169 |
| 2,337,429 | 12/1943 | Tomlinson | 166/278 |
| 2,905,245 | 9/1959 | De Priester | 166/278 |
| 3,216,497 | 11/1965 | Howard et al. | 166/296 |
| 3,268,001 | 8/1966 | Brandt | 166/296 |
| 3,880,233 | 4/1975 | Muecke et al. | 166/296 |
| 3,905,423 | 9/1975 | Sparlin et al. | 166/315 |

*Primary Examiner*—Ernest R. Purser
*Attorney, Agent, or Firm*—Donald W. Canady

[57] ABSTRACT

A method for transporting gravel to a production zone with a circulating well fluid to uniformly pack the gravel in the annular space in the wall between the perforated liner and the formation whereby the fluid enters the perforated liner after depositing gravel at the top of the annular column of gravel and flows through the liner inner annulus into a tailpipe through which the well fluid is returned to the surface.

The well fluid carrier for the gravel is prevented from entering the perforated or slotted liner except at the top of the gravel sheath by a semi-solid material prepositioned in the slotted liner-tailpipe annulus. The semi-solid material is progressively eroded by the well fluid entering the slotted liner-tailpipe annulus at the top of the gravel sheath.

11 Claims, 4 Drawing Figures

OIL WELL GRAVEL PACKING METHOD AND APPARATUS

BACKGROUND OF THE INVENTION

Well gravel packing is a conventional oil field technique for screening formation sand and sediments from entering the well with the produced fluids which would clog up the well and detour or prevent production of the fluids. Basically, gravel packing refers to the petroleum industry practice of surrounding with gravel or coarse sand, the perforated liner through the producing formation in an oil or gas well. When properly placed in the annular space between the wall of the well and the perforated liner, gravel supports the walls, prevents caving of loose material against the liner and and serves to restrain sand from unconsolidated and disintegrating strata so that it may not enter the well. More effective screening of sand, possible by this means, diminishes the destructive influence of sand scouring on well equipment and tends to reduce maintenance costs. Equipment repairs and well clean-out operations are less frequent and the well is able to produce for a greater part of the time than would otherwise be the case. The well so protected is therefore capable of maintaining a larger average monthly production rate. With gravel to sustain the walls of the well, it is possible to form and maintain a hole of larger diameter through the producing formation without elsewhere increasing the normal diameter of the well or that of the well casing. The larger diameter hole through the producing zone results in increased production efficiency.

Although the gravel may be simply "dumped" into the well to fall into place to form the aforementioned annular column or gravel sheath, it is more commonly emplaced in the well by circulating the gravel in a fluid carrier which is pumped from the surface. The fluid returned from the well is recirculated by conventional drilling pumps through well fluid treating equipment and thence through a gravel pack machine which blends the prepared gravel in the circulating well fluid. The gravel carrying fluid is then pumped down into the well through the drill pipe to a cross-over tool wherein it is directed to the annulus between the perforated pipe or liner and the under-reamed hole below the cemented casing. The gravel-well fluid mixture then continues down the outer annulus of the perforated liner to the bottom of the hole or to the top of the gravel sheath which has accumulated at the bottom of the hole outside of the perforated liner as the packing progresses. Since the perforated wall of the liner offers less resistance to the fluid as it reaches the top of the gravel sheath, than does the gravel sheath, the fluid enters the inner annulus of the liner through the perforations therein and flows down through the annulus to the bottom of the fluid return tailpipe which is positioned concentrically within the perforated liner. The gravel, of course, is too large to enter the liner perforations or slots and thus remains in the outer annulus while the fluid passes up through the tailpipe to the cross-over tool in which it is directed to the annulus between the drill pipe and the casing, through which annulus it returns to the surface. Sufficient gravel is pumped into the under-reamed well to accumulate gravel in the well to completely envelop the perforated liner in a sheath of gravel several inches thick.

As the gravel enters the well and accumulates in the under-reamed hole, there is a tendency of the liner perforations to plug and for the gravel to bridge or dune before reaching the bottom of the free space, thus leaving voids in the gravel, which reduce the efficiency of the gravel pack in screening the formation sand and sediments from the well fluid entering the perforated liner. In order to cause the fluid carrying the gravel to move down through the outer annulus to the top of the gravel sheath before entering the liner, it is desirable to seal or blank off the perforations of the liner down to the top of the gravel sheath and then remove the perforation seal at that area so that the fluid will enter the liner only in this area. The tendency for gravel to bridge is particularly troublesome in slant drilling operations, however, maintenance of the fluid velocity down to the top of the gravel sheath reduces the tendency for the gravel to bridge and create voids in the gravel pack, and also aids in the compaction of the gravel.

Prior art efforts to limit entry of the well fluid to the top of the gravel sheath have included such techniques as plugging the perforations with litharge or sulfur, lining the liners with cement, and placing swab cups at every joint of the liner. Recent efforts have utilized thin rubber flanges at every joint, or a collapsible valve positioned at every six foot interval. None of these prior art attempts to limit the entry of the well fluid into the perforated liner at the top of the gravel sheath, has been completely satisfactory as some of the well fluid still enters the liner intermittently throughout its length. Also these prior art techniques reduce the speed of the gravel packing operation and increase the difficulty of the operations.

Accordingly, it is an object of my present invention to provide a gravel packing method wherein all of the liner perforations are temporarily plugged but opened at the top of the gravel as the level of the gravel rises in the well, thus permitting passage of well fluids into the liner at the upper level of the gravel pack sheath accumulating in the well.

It is also an object of my present invention to provide a liner perforation seal for use in gravel packing operations which prevents entry of gravel-carrying fluid into the liner.

It is also an object of my present invention to provide in a gravel packing operation, a means for temporarily sealing a perforated liner against the passage of well fluids into the liner and which will permit entry of the fluid at the vicinity of the top of the gravel sheath.

It is a further object of my present invention to provide a gravel packing method wherein the annulus between the perforated liner and the fluid return tailpipe is filled with a semi-solid material which is impervious to well fluid at normal pressures but pervious to well fluid at increased pressures.

It is also an object of my present invention to provide a ported tailpipe for gravel packing operations in which longitudinally spaced ports are sequentially opened at the level of the top of the gravel pack sheath to permit entry of the well fluids into the tailpipe at that level.

BRIEF SUMMARY OF THE INVENTION

It is proposed by my present invention to provide an improved gravel packing method wherein the annular gravel pack sheath is uniformly packed and the well fluid carrier is prevented from entering the perforated liner except at the top of the accumulated gravel pack, by providing a degradable semi-solid material in the annulus between the perforated liner and the tailpipe which is impervious to the well fluid except at the top of the column of the gravel pack accumulated in the liner formation annulus and which is progressively penetrated as the column rises in the liner-formation annulus. According to one embodiment of my invention, a series of tailpipe ports which are normally closed when the semi-solid material is intact, are sequentially opened as the well fluid breaks through the material at the top of the gravel column, as the column builds up to a point adjacent the individual ports.

DETAILED DESCRIPTION OF THE INVENTION

Figure 1:
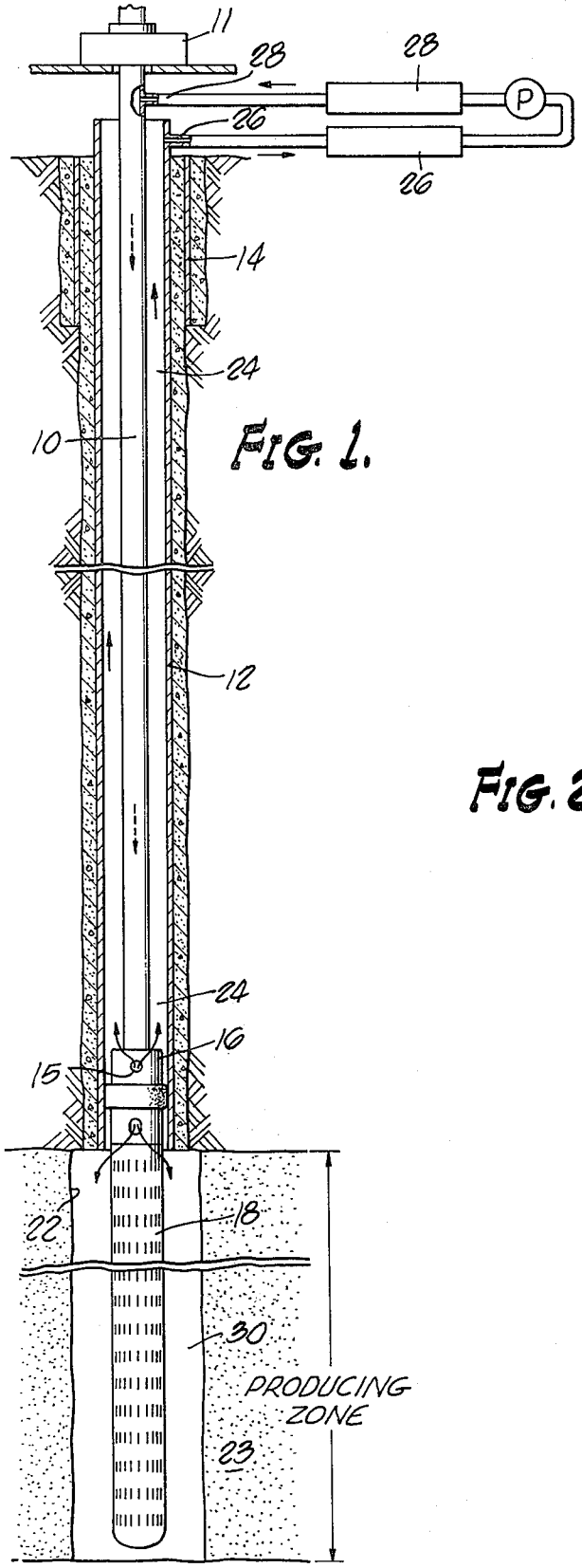
FIG. 1 shows an elevational view through an oil well, partially in section, showing an overview of a gravel packing operation.

An oil well is shown in FIG. 1 equipped for gravel packing operations. The drill pipe 10 is shown extending below the rotary table 11 through the production casing 12 which is cemented into the formation below the surface pipe 14 down to the producing formation 23, as shown. A crossover tool 16 supports the liner 18 and the drill pipe stinger or tailpipe 20 in the under-reamed portion 22 of the well in the producing zone 23. The cross-over tool 16 is connected to the lower end of the drill pipe 10.

Figure 2:
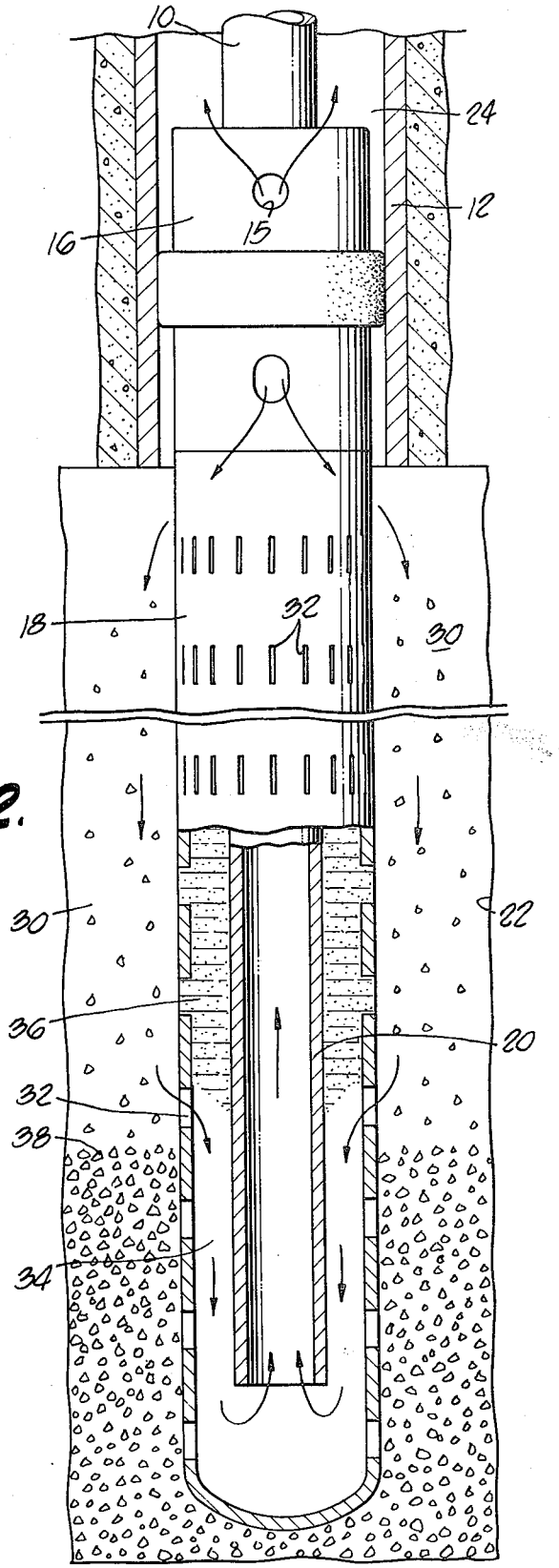
FIG. 2 is an enlarged view, partially in section, of the producing zone apparatus of FIG. 1, showing a perforated well liner in a producing zone and a fluid return tailpipe extending from the lower end of the drill pipe to the bottom of the liner during a gravel packing operation.

FIG. 2 shows an enlarged view of the downhole portion of the gravel packing operation. Well fluid is circulated through the cross-over tool 16, down the enlarged annulus outside the liner 18 and into the liner and up the lower end of the tailpipe 20. From the tailpipe, the well fluid flows up to the crossover tool 16 where it is directed through port 15 into the annulus 24 between the production string 12 and the drill pipe 10. The well fluid from the annulus 24 is returned through a side outlet 26 to the conventional surface processing equipment, e.g. shakers, suction pit, pump, gravel packing blending machine, and then returned as a gravel slurry to the drill pipe 10 through the return pipe 28. In the gravel packing machine, which is conventional oil field equipment, the gravel to be packed as a sheath around the liner 18, is blended in the well fluid which suspends the gravel for carriage down through the drill pipe 10 to the crossover tool 16 which directs the slurry to the outer annulus 30 between the under-reamed cavity 22 and the liner 18, as best shown in FIG. 2. The gravel is deposited at the bottom of the annulus 30 and the well fluid carrier passes into the liner through the perforations or slots and thence into the annulus 34 between the perforated liner 18 and the tailpipe 20, and then down the annulus 34 to a port or the bottom of the tailpipe 20 and then up through the tailpipe to the crossover tool 16 where it is directed to the annulus 24 between the drill pipe 10 and the production casing 12 and returned to the surface through the shakers, pump, and gravel packing machine, etc. All of the foregoing is performed in accordance with conventional gravel packing operations.

Wells which deviate as much as 45 degrees or more from the vertical, present special problems since the gravel will not simply fall into place around the liner. Hence the gravel-well fluid slurry must be pumped into the liner annulus at a high fluid velocity to prevent the gravel from coming to rest on the low side of the hole and forming a blockage of the annulus which would leave a void in the gravel pack. Another problem in gravel packing is caused by the lodging of smaller gravel particles in the slots, which can result in a substantial reduction of the effective slot area. In accordance with conventional gravel packing techniques, all of the well fluid which is used to transport gravel through the annulus, passes through the perforations by the path of least resistance, into the liner and, of course, carries with it small particles of gravel which may plug the perforations. Hence, it is highly desirable to limit or even prevent well fluid from entering the liner above the top of the gravel packed sheath.

In accordance with my present invention, the well fluid is prevented from entering the liner 18 through the perforations 32 by inserting a semi-solid material 36 in the annulus between the tailpipe and the perforated liner. Thus, as best shown in FIG. 2, the gravel carrying well fluid is forced to move downward through the annulus 30 and deposit the gravel on the top of the gravel column or sheath 38 which is building up from the bottom of the annulus. The liner perforations 32 are closed by the semi-solid material 36 which fills the annulus 34 from the cross-over tool 16 to the top 38 of the gravel sheath where the well fluid breaks through the sealing material. The slots are thus open from the bottom of the liner 20 to the level of the top 38 of the gravel pack sheath accumulating in the well around the perforated liner, as shown in FIG. 2.

The well fluid, after depositing gravel on the top of the column of gravel at 38, then enters the liner through the next perforation above the top 38 of the column of gravel, since the column of gravel offers more resistance to the flow of the well fluid therethrough than does the semi-solid material 36 in the annulus 34.

The gelled material 36 is insoluble in oil and water and of such a consistency that a pressure differential of about 5 p.s.i. will break it away from the perforation opening over a limited area above the top of the gravel column where the fluid pressure increases by about 5 to 10 p.s.i. The gelled fluid which breaks away from the perforation is carried with the well fluid down through the annulus and up through the tailpipe to the surface. The aformentioned pressure increase in the well fluid causes a removal of substantially all of the gelled material in the annulus 34 in the path that the well fluid follows into the tailpipe as it flows into the liner through the perforations at the top of the gravel column, so that the gelled fluid is effectively removed from the annulus 34 progressively upwardly at approximately the level of the top 38 of the gravel pack accumulatin g in the annulus 30.

The gelled material suitable for use in my present invention may be any of the commercially available gel materials conventionally used in oil fuel operations such as polyacrylamide, polyethelene oxide or polyisobutylene gels. Suitable polyacrylamide gels are commercially available from Halliburton Services Company as "PWG," from Dow Chemical Company (Dowell Division) as "Channelblock" and American Cyanamid Company as "AM-9".

The gelled material is emplaced in the annulus between the tailpipe and the liner, before they are hung from the crossover tool in the under-reamed cavity 22. The liner, tailpipe and crossover tool are assembled and the gelled material emplaced in accordance with one of several techniques. For example, the liner may be wrapped with a plastic tape to cover the perforations and the gelled material in a fluid condition, placed in the annulus through a discharge opening above the crossover tool, with sufficient time allowed for the material to gel. The plastic tape is removed and the liner is then run into the under-reamed cavity and the gravel packing operation commenced as described above. The gelled material below the tailpipe can be removed by applying pressure through the tailpipe to break open the perforation adjacent the bottom of the tailpipe.

As an alternate to the above-described method for emplacing the gelled fluid into the liner-tailpipe annulus, a cylindrical tank equipped with a contractible sleeve may be employed and the assembled liner, tailpipe and crossover tool inserted into the tank within the sleeve and the sleeve collapsed around the liner to seal off the perforations so that the gelling fluid will not escape the annulus through the perforations, prior to gelling. The gelling fluid is then injected into the annulus, and after the gelled fluid has gelled, the sleeve expanded and the liner-tailpipe-crossover tool assembly removed from the tank.

Figure 3:
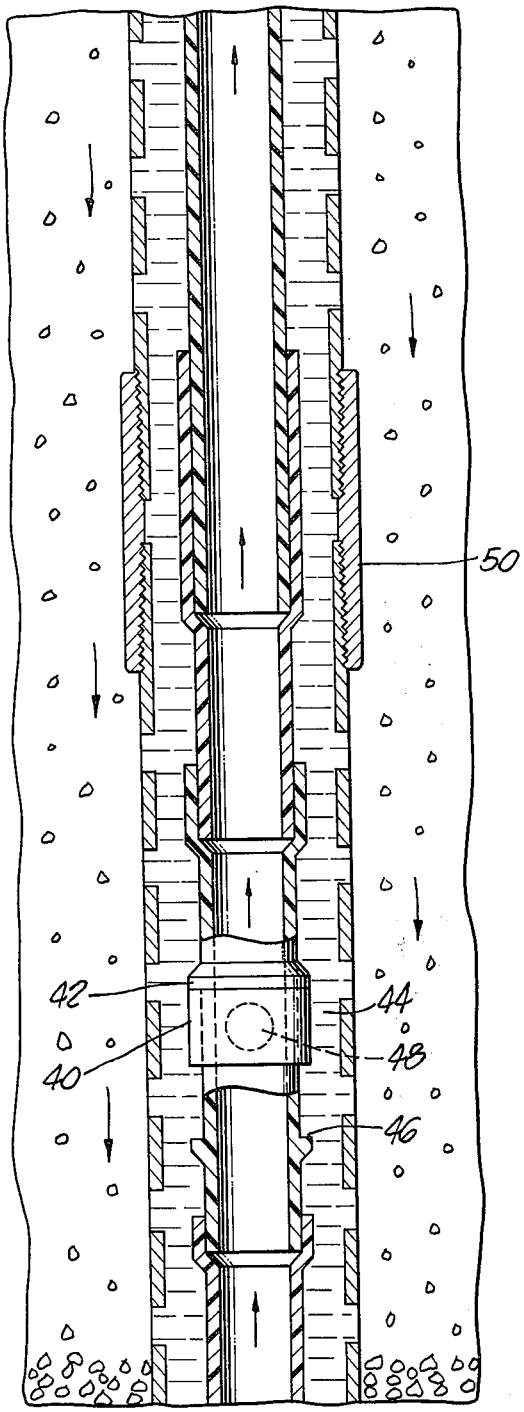
FIG. 3 is an enlarged view, partially in section, of a tailpipe modified in accordance with an embodiment of my present invention with the ported collar closed off during the initial stage of the gravel packing operation.
Figure 4:
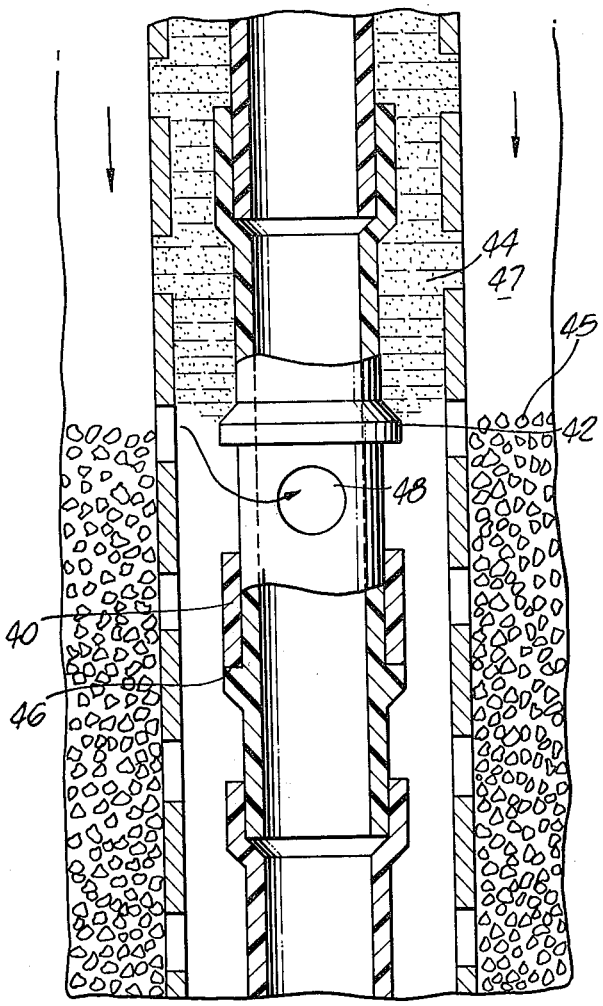
FIG. 4 shows an enlargement, partially in cross section, of the modification of my invention shown in FIG. 3, with the collar port open.

According to the embodiment of my present invention shown in FIGS. 3 and 4 port collars 42 are provided in the tailpipe assembly so that additional openings into the tailpipe are available for the entry of well fluid. Ports are thus provided at intervals along the tailpipe so that as the gravel packing operation proceeds the well fluid can enter the tailpipe at a point above the bottom of the tailpipe rather than be required to pass to the bottom of the tailpipe for a point of entry, thus reducing the fluid friction both in the annulus between the liner and the tailpipe where the fluid is moving downwardly, and in the inside of the tailpipe where the fluid is moving upwardly to the crossover tool. Since the distance the fluid travels is shortened, the fluid friction will be reduced which, in turn, will reduce the pump requirements for the circulating system and thereby reduce pressures on the producing zone.

The tailpipe may be made of a lightweight plastic or fiberglass material and successive sections provided with an adhesive for bonding into the lower (female) sections of tubing to which they are inserted as the liner and the tailpipe are made up, the liner joints being fastened with conventional threaded couplings 50, as shown in FIG. 3.

In accordance with the tailpipe ported collar embodiment, shown in FIGS. 3 and 4, the port 48 of FIG. 3 is closed by an external sleeve 40 positioned over the port and held in such position by the gelled material in the tailpipe-liner annulus. The port is closed by moving the sleeve 40 to a position over the port before injecting the gelling fluid into the annulus. As the gelled material is eroded from that portion of the tailpipe-liner annulus surrounding the sleeve 40, the sleeve is free to slide downwardly on the tailpipe to shoulder 46, thus automatically opening the port 48 as the gravel accumulates around the perforated liner above the level of the side outlet. The port is opened when the sleeve slides downwardly against shoulder 46, thus uncovering the port 48.

FIG. 3 shows the ported tailpipe collar assembly with the sliding sleeve 40 in closed position against the shoulder 42 and held in closed position by the gelled fluid in the annulus 44. As the gelled fluid is removed from the annulus 44 as the column of gravel 45 rises in the outer annulus 47, as shown in FIG. 4, and as described above in respect to FIG. 2, the gelled fluid surrounding the upwardly positioned sleeve 40 will be removed and the sleeve will then slide or move to the position shown in FIG. 4 and rest on the lower shoulder 46, thus leaving the port 48 "open" to the entry of fluid therethrough into the tailpipe at the level approximate the top 45 of the column of gravel accumulating in the outer annulus 47.

While my invention has been described herein with reference to specific embodiments, with a certan degree of particularity, it is to be understood that my invention is not to be limited to the details set forth herein, but rather should be afforded the full scope of the appended claims.

I claim as my invention:

1. In a method for packing gravel in a well cavity around a perforated liner through a producing zone of an oil or gas well from surface apparatus arranged for blending prepared gravel with a circulating well fluid wherein the blended gravel-fluid mixture is pumped from the surface to said well cavity, and wherein a tailpipe is suspended concentrically within said perforated liner from tubular apparatus exending from the surface to said producing zone, the improvement comprising the steps of:

a. filling the annulus between said tailpipe and said liner with a gel material which gells after said material is placed in said annulus, b. hanging said tailpipe and liner assemblage in said well cavity adjacent said producing zone c. pumping said gravel-fluid mixture from said surface through said tubular apparatus and into said cavity to deposit gravel in said cavity with said fluid separating from said gravel and entering the liner through said perforations progressively upwardly proximate the top of the sheath of said deposited gravel accumulating in said cavity, and d. circulating said separated fluid through the perforations of said liner into said annulus to erode said gelled material in the path defined from said perforations to an opening in said tailpipe and return to said surface gravel blending apparatus through said tailpipe and said tubular apparatus.

2. A method in accordance with claim 1 wherein said separated fluid is circulated to said surface gravel blending apparatus through said liner perforations proximate the level of said gravel sheath and down said annulus and into the bottom of the tailpipe.

3. A method, in accordance with claim 1, wherein said separated fluid is circulated to said surface gravel blending apparatus through a port in said tailpipe.

4. A method in accordance with claim 1 wherein said separated fluid is circulated through said perforations in said liner at the level of the top of said gravel sheath accumulated in said cavity and around said liner, and flows into said annulus where said fluid erodes said gelled material in the area proximate a side opening in said tailpipe to open said side opening through which said fluid is circulated to said surface gravel blending apparatus.

5. The method of claim 4 wherein said gelled material is a polyacrylamide.

6. An apparatus for packing gravel in a well cavity around a perforated liner through a producing zone of an oil or gas well from surface apparatus arranged for blending prepared gravel with a circulating well fluid and pumping the blended gravel-fluid mixture from the surface to said well cavity, and wherein a tailpipe is suspended concentrically withim said perforated liner from tubular apparatus extending from the surface to said production zone, the improvement comprising: a side outlet in said tailpipe imtermediate the top and bottom of said perforated liner for recirculating fluid from said gravel-fluid mixture after the deposition of said gravel in said well cavity, and means for covering said side outlet to block the entry of said recirculated fluid until said deposited gravel has accumulated in said well cavity around said liner to a level proximate said side outlet, and means automatically removing said covering means from said side outlet as said gravel accumulates around said perforated liner above the level of said side outlet.

7. Apparatus in accordance with claim 6 wherein said side outlet covering means is a sleeve slideably mounted on said tailpipe.

8. Apparatus in accordance with claim 6 including a plurality of said tailpipe side outlets.

9. In an apparatus for packing gravel in the well cavity around a perforated liner through a producing zone of an oil or gas well from the surface apparatus arranged for blending prepared gravel with a circulated well fluid and pumping the blended gravel-fluid mixture from the surface to said well cavity, and wherein a tailpipe is suspended concentrically within said perforated liner from tubular apparatus extending from the surface to said production zone, the improvement comprising:

a side outlet in said tailpipe intermediate the top and bottom of said perforated liner, gelled material filling the annulus between said tailpipe and said perforated liner for preventing entry of said gravel-fluid mixture into said annulus, said gelled material being penetrable in response to a local increased pressure of said fluid, means for blocking said side outlet in said tailpipe when said gelled material is intact in said annulus, said blocking means being actuated to unblock said side outlet and permit flow of said fluid into said tailpipe through said side outlet, when said gelled material is eroded from the annulus proximate said side outlet.

10. The apparatus of claim 9 wherein said blocking means is a sleeve longitudinally slideable in said tailpipe.

11. The apparatus of claim 9 including a plurality of said side outlets longitudinally spaced along said tailpipe.

* * * * *